United States Patent [19]

Hashish et al.

[11] Patent Number: 4,951,429

[45] Date of Patent: Aug. 28, 1990

[54] ABRASIVEJET NOZZLE ASSEMBLY FOR SMALL HOLE DRILLING AND THIN KERF CUTTING

[75] Inventors: Mohamed Hashish, Kent; Steven J. Craigen, Auburn, both of Wash.

[73] Assignee: Flow Research, Inc., Kent, Wash.

[21] Appl. No.: 335,054

[22] Filed: Apr. 7, 1989

[51] Int. Cl.[5] ..... B24C 5/04

[52] U.S. Cl. ..... 51/439; 51/436; 51/410

[58] Field of Search ..... 51/410, 424, 436, 321, 51/319, 262 A, 439; 83/107; 239/423

[56] References Cited

U.S. PATENT DOCUMENTS

| | | | |
|---|---|---|---|
| 2,905,050 | 3/1961 | Schwacha | 51/439 |
| 4,165,587 | 8/1979 | Cottingham et al. | 51/439 |
| 4,555,872 | 12/1985 | Yie | 51/319 |
| 4,563,840 | 1/1986 | Urakami | 51/410 |
| 4,648,215 | 3/1987 | Hashish et al. | 51/439 |
| 4,711,056 | 12/1987 | Herrington et al. | 51/321 |

*Primary Examiner*—Frederick R. Schmidt
*Assistant Examiner*—Mark F. Frazier
*Attorney, Agent, or Firm*—Ashen Goland

[57] ABSTRACT

An abrasivejet nozzle assembly is disclosed which is particularly suitable for drilling small diameter holes in a workpiece. Such assemblies include a mixing region wherein abrasive particles are entrained into a high velocity waterjet formed as high pressure water is forced through a jet-forming orifice. Among the unique features of the nozzle assembly are an inwardly tapered abrasive path just upstream of the mixing region, flushing conduits immediately upstream and downstream of the mixing region, and a venting passageway upstream of the mixing region which prevents the backflow of abrasive dust towards the jet-forming orifice.

17 Claims, 2 Drawing Sheets

ABRASIVEJET NOZZLE ASSEMBLY FOR SMALL HOLE DRILLING AND THIN KERF CUTTING

This invention relates to cutting systems of the type utilizing a high velocity, abrasive-laden liquid jet.

The use of high velocity, abrasive-laden liquid jets to precisely cut a variety of materials is well known. Briefly, a high velocity waterjet is first formed by compressing the liquid to an operating pressure of 35,000 to 70,000 psi, and forcing the compressed liquid through an orifice having a diameter approximating that of a human hair; namely, 0.001–0.015 inches. The resulting highly coherent jet is discharged from the orifice at a velocity which approaches or exceeds the speed of sound.

The liquid most frequently used to from the jet is water, and the high velocity jet described hereinafter may accordingly be identified as a waterjet. Those skilled in the art will recognize, however, that numerous other liquids can be used without departing from the scope of the invention, and the recitation of the jet as comprising water should not be interpreted as a limitation.

To produce the abrasive-laden waterjet, the high velocity jet passes through a mixing region wherein a quantity of abrasive is entrained into the jet by the low pressure region which surrounds the flowing liquid in accordance with the Bernoulli Principle. The abrasive is typically (but not limited to) a fine silica or garnet, and is typically drawn via a conduit into the mixing region from an external hopper by the Bernoulli-induced suction.

The abrasive-laden waterjet is then discharged against a workpiece that is supported closely adjacent to the discharge end of the nozzle housing. Additional information and details concerning abrasivejet technology may be found in U.S. Pat. No. 4,648,215, the contents of which are hereby incorporated by reference The term "abrasivejet" is used herein as a shorthand expression for "abrasive-laden waterjet" in accordance with standard terminology in the art.

New applications in the electronics and aerospace industries require the drilling of small holes and/or the creation of minimal kerf in workpieces formed from brittle materials, composites, and laminates. For example, many aerospace components consist of a metal substrate coated with ceramics for thermal protection. Although abrasivejets have been used to cut a wide variety of materials, no commercially satisfactory apparatus has been available for drilling small diameter holes (i.e., as small as 0.010 inches) in brittle materials, composites and laminates, or cutting such materials with the minimal kerf (i.e., 0.010 inches wide). In practice, these aforementioned materials tend to chip, crack, fracture, or delaminate when impinged upon by the abrasivejet.

While the drilling of small holes and the cutting of minimal kerf would appear to the layman to merely require the use of a small diameter abrasivejet, this is not the case. In practice, a reduction in jet diameter has resulted in non-uniform cutting, delamination of the workpiece or an unacceptable degradation in cutting speed.

SUMMARY OF THE INVENTION

The invention herein is an abrasivejet nozzle assembly for use in an abrasivejet cutting system for drilling small diameter holes and/or cutting small widths of kerf in a brittle, composite or laminate material. The nozzle assembly comprises housing means having an inlet end for receiving high pressure liquid, and an outlet end downstream from the inlet end. Orifice-defining means is positioned between the inlet and outlet ends for forming a high velocity liquid jet from the high pressure liquid.

The housing means including an abrasive-conducting inlet passage for conducting abrasive from a source external to the nozzle assembly to a mixing region downstream from the jet-forming orifice so that abrasive particles become entrained in the jet. At least a portion of the abrasive-conducting inlet passage is generally converging in the direction of abrasive travel.

The housing means further includes an abrasive exit conduit in fluid communication with the mixing region for conducting abrasive out of the nozzle assembly along a path separate from that taken by the jet, and means defining a discharge conduit downstream from the mixing region for conducting the abrasive-laden liquid cutting jet out of the nozzle assembly, the discharge conduit having a length-to-width ratio in the range from 100 to 500.

In accordance with another aspect of the invention, a removably securable insert for use in the nozzle housing is described, and comprises a body of wear-resistant material having a pair of intersecting through-passages, one of said through-passages having a cross-section in the range of 10 to 50 times the diameter of the jet. The other of the passages is convergingly shaped at one end in the direction towards the intersection.

Additional details and features of the invention will become evident in the following description of a preferred embodiment, of which the Drawing is a part.

DESCRIPTION OF THE PREFERRED EMBODIMENT

Figure 1:
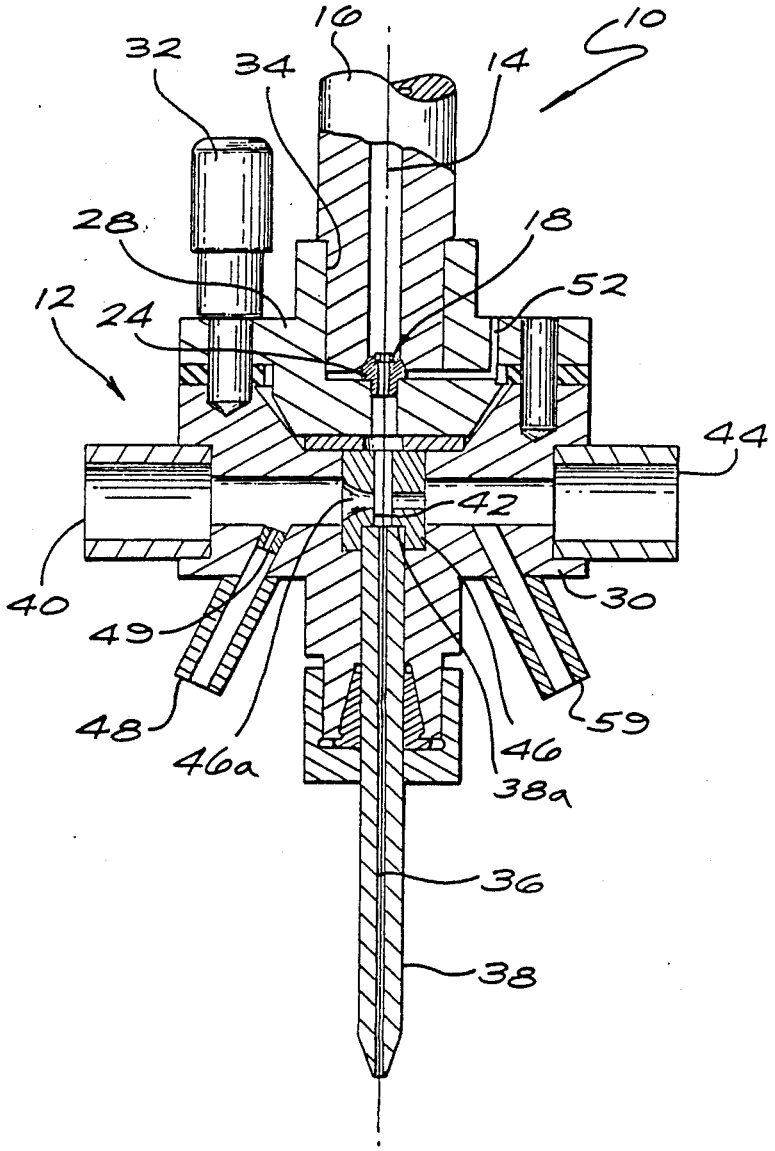
FIG. 1 is front view in section of an abrasivejet nozzle assembly in accordance with the invention.

Referring initially to FIG. 1, an abrasivejet nozzle assembly constructed in accordance with the invention is shown to comprise a waterjet orifice housing 10 and an abrasivejet housing 12. The waterjet orifice housing 10 has an axially-extending passage 14 extending from an upstream end region 16. An inlet port (not shown) in the upstream end region 16 permits the ingress of high pressure water (or other suitable liquid) into the passage 14. Typically, the passage is approximately 6.3 mm (0.25 inches) in diameter. The term "high pressure" is used to denote pressures in the range of 35,000 to 55,000 psi. Those skilled in the art will recognize that the sources of such highly pressurized water are typically intensifier pumps which form part of an abrasivejet cutting system. A description of these pumps is beyond the scope of this specification, and is accordingly omitted for the sake of brevity.

Figure 2:
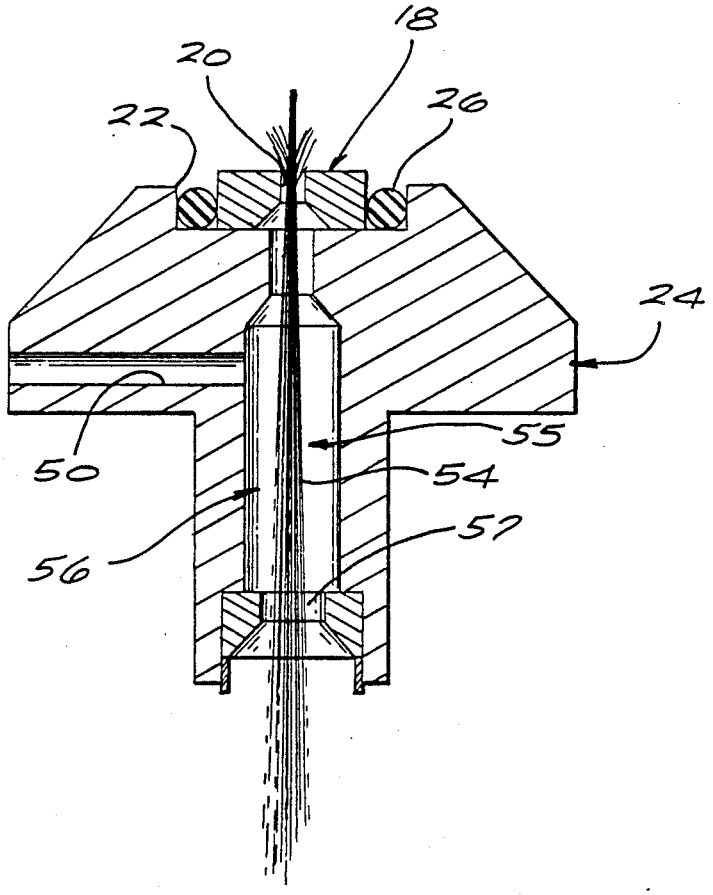
FIG. 2 is an enlarged view of the jet-forming orifice assembly illustrated in FIG. 1.

A jewel orifice-defining member 18, shown more clearly in magnification in FIG. 2, has a jet-forming orifice 20 approximately 0.076 to 0.457 mm (0.003 to 0.018 inch) in diameter and positioned in the downstream end region of the passage 14 to produce a highly coherent, high velocity cutting jet from the high pressure water passing through the orifice. The jewel orifice member 18 is preferably formed from an extremely hard material such as synthetic sapphire or diamond. The jewel member 18 is securely sealed within a recess 22 of a holder member 24 by an 0-ring or seal 26, and is sealed against the holder member by the high pressure liquid in the passageway 14, as is known in the art.

Returning to FIG. 1, the abrasivejet body 12 is shown to comprise upper and lower body members 28, 30 which are secured together by three screws 32. The three screws are spaced 120° apart around the top of the upper body member; however only one such screw appears in FIG. 1 for visual clarity. The upper body member 28 is preferably secured to the waterjet housing 10 by an internally threaded, cylindrical cavity 34 which threads onto external threads circumventing the downstream end of the waterjet housing 10.

The abutting faces of the upper and lower body members 28, 30 are shaped to form a "ball and socket" arrangement which enables the axially-extending passageway 36 of a discharge tube 38 in the lower member to be axially aligned with the jet-forming orifice 18 by means of the selective rotation of the adjustment screws 32. Additional details concerning the alignment mechanism may be found in co-pending U.S. Ser. No. 794,234, filed Oct. 31, 1985 which is assigned to the present assignee. The contents of that patent application are incorporated by reference.

The lower body member 30 further includes an abrasive-conducting entry passage 40 for conducting abrasive from an external hopper (or other source) to a mixing region 42 within the lower body member. As is known in the art, the abrasive typically comprises (but is not limited to) a fine garnet or silica powder, and is drawn into the assembly by the low pressure surrounding the moving jet in accordance with the Bernoulli Principle. The abrasive is conducted to the mixing region downstream from the jet-producing orifice 18 and adjacent the high velocity jet so that the abrasive becomes entrained with the jet by the low pressure region which surrounds the moving liquid. Additional details concerning the formation of abrasive jets are set forth in U.S. Pat. No. 4,648,215 which issued on Mar. 10, 1987 to Hashish, et. al. The contents of that patent are incorporated by reference.

An abrasive outlet passage 44 for conducting abrasive and/or abrasive-laden liquid is also formed in the lower body member 30. The abrasive outlet passage 44 communicates at one end with the mixing region 42, and is preferably diametrically opposite to, and co-axially aligned with, the inlet abrasive passage 40. The outlet passage 44 is coupled to a vacuum device which maintains a generally constant inflow of abrasive from the external hopper through the inlet passageway 40 during periods in which the Bernoulli Effect surrounding the flowing jet 55 is insufficient to maintain a level of abrasive flow which yields satisfactory cutting and/or drilling. Details concerning the use of vacuum-assisted abrasive flow are described in greater detail in my copending U.S. patent application Ser. No. 308,730 filed Feb. 9, 1989, the contents of which are incorporated by reference.

In accordance with one aspect of the invention, the flow of abrasive within the inlet passageway 40 is focused by the generally converging walls of a throughbore **46*a* formed in an insert member 46. The throughbore 46*a* extends generally perpendicular to the direction of jet travel, intersecting the jet's path within the mixing region 42. In practice the converging section of the bore 46*a* has a widest diameter of approximately 3.8 to 6.3 mm (0.15 to 0.25 inches), and a narrowest diameter of approximately 2.5 mm (0.1 inches). By forcing the abrasive into a flow pattern of smaller diameter, the abrasive is much less likely to circumvent the thin jet and either exit via the abrasive exit passage 44** or accumulate within the nozzle housing.

Accumulation of abrasive within the housing is further minimized by the provision of a flushing inlet passage 48 in communication with the abrasive-conducting passageway upstream of the mixing region. In operation, the flushing inlet 48 is coupled to a source of low pressure water or other suitable liquid. In practice, a low-pressure line allowing up to 1 gallon per minute of water at up to 100 psi of pressure has been found suitable for the connection. The addition of a flushing orifice 49 results in a suitable abrasive-flushing jet when an ordinary tap water is used. Low pressure flushing liquid preferably enters the cutting nozzle assembly under the influence of the vacuum source coupled to the abrasive outlet passage 44, and flushes the insert of any remaining abrasive material after the drilling and/or cutting operation is complete.

The lower member 30 of the abrasivejet body additionally includes a second flushing passage 59 in communication with the abrasive-conducting outlet passage 44 downstream of the mixing region. In practice, a low pressure line allowing up to 2 gallons per minute of water at up to 100 psi of pressure has been found suitable for the connection. The low pressure flushing fluid preferably enters the nozzle assembly under the influence of the vacuum source while the cutting or drolling operation is in progress to insure that no abrasives accumulate in the mixing region. The downstream flushing water should not be allowed to enter the mixing region, and its flow rate can be adjusted to prevent that from occurring.

The discharge tube 38 is positioned in an axially-extending bore formed within the lower body member 30. The tube 38 is formed from tungsten carbide, or other extremely hard material, and has an internal diameter of from 0.25 to 5 mm (0.010 to 0.10 inches), a typical length of 10 to 25 cm (4 to 10 inches), and a length-to-diameter ratio of from 100–500. The downstream end of the discharge tube 38 is positioned closely adjacent the workpiece during the cutting operation and discharges the abrasive-laden jet against a workpiece. In practice a set-off distance of 0.25 to 2.55 mm (0.01 to 0.10 inches) is satisfactory.

The exterior downstream end of the discharge tube 38 is preferably machined down to form a conical shape to permit operation against inclined surfaces with minimum set-off distance. Typical conical angles are 20° to 45° included angle. The diameter of the flat end **38*a* of the discharge tube is preferably very small; e.g., in the range of 1.1 to 2 times the internal diameter of the discharge tube 38**.

In operation, it has been discovered that quantities of fine abrasive material accumulate on the jet-forming orifice member 18, severely accelerating its failure rate when the abrasive is sucked along through the orifice with the jet, especially when fast-acting on/off valves are used. Under those conditions, the jet-forming orifice is subjected to the impact of abrasive particles, and is quickly fractured or worn out of tolerance. It is believed that the cause of the problem lies in the pressure differential between the environment external to the nozzle assembly housing and the low pressure environment surrounding the jet as a result of its high velocity motion. That pressure differential causes air to flow up the passageway 56 towards the orifice member, gathering a quantity of abrasive "dust" as it does so. Upon the fast closure of the high pressure waterjet flow, a low pressure develops above the jet-forming member 18 due to a hydraulic transient phenomenon. This causes the dust to accumulate on the jewel element. When the high pressure jet is activated again, the dust is picked up by the high pressure fluid and is forced through the jet-forming orifice. The entrained abrasives quickly damage the orifice member.

To substantially eliminate the "backflow" of abrasive material up below the discharge tube, the orifice holding member 24 is provided with a radially extending passageway 50 having one end in communication with the jet, and its other end in communication with the environment external to the nozzle housing. Communication with the external environment is made through a weep hole 52 in the upper body member 28 which also allows leaking water to escape from between the waterjet nozzle housing 10 and the orifice supporting member 24. A radial passageway 50 having a diameter of from 3 to 10 times that of the waterjet has been found to be satisfactory, and a diameter of 1 mm (0.040 inches) has been found suitable for a wide range of jet diameters.

To further restrict the migration of abrasive dust up the sides of the jet-discharging passageway 56, a secondary orifice 57 is positioned in the jet path upstream of the mixing region. The secondary orifice is approximately 1.5 to 5 times the diameter of the jet-forming orifice, to allow for a slight spreading of the waterjet. The size of the secondary orifice is sufficiently close to that of the waterjet to physically obstruct or impede the counterflow of air. Consequently, the pressure differential described above draws substantially all of its air through the passageway 50. Since the axial length of the secondary orifice is minimal, any drag on the waterjet by its close dimension is of little or no effect. By contrast, the diameter of the axially extending channel 54 which couples the jet-forming orifice to the secondary orifice is from 5 to 50 times that of the jet, permitting the jet to travel freely.

While the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

I claim:

1. An abrasivejet nozzle assembly for use in an abrasive jet cutting system comprising:

housing means having an inlet end for receiving high pressure liquid, and an outlet end downstream from the inlet end;

jet-forming orifice-defining means positioned between the inlet and outlet ends for forming a high velocity liquid jet from the high pressure liquid, the housing means including an abrasive-conducting inlet passage for conducting abrasive from a source external to the nozzle assembly to a mixing region downstream from the jet-forming orifice so that abrasive becomes entrained in the jet to form an abrasive jet, at least a portion of the abrasive-conducting inlet passage being generally converging in the direction of abrasive travel, the housing means further including an abrasive exit conduit in fluid communication with the mixing region for conducting abrasive out of the nozzle assembly along a path separate from that taken by the jet; and means defining a discharge conduit downstream from the mixing region for conducting the abrasive jet out of the nozzle assembly, the discharge conduit having a length-to-width ratio in the range from 100 to 500.

2. The nozzle assembly of claim 1 wherein the housing means includes a jet-accommodating passage between the jet-forming orifice and the mixing region, the jet-accommodating passage having cross-section dimensions in the range of 10 to 50 times the diameter of the jet.

3. The nozzle assembly of claim 2 wherein the generally converging portion of the abrasive-conducting inlet passage reduces the cross-section of said passage by 30% to 70%.

4. The nozzle assembly of claim 2 wherein the generally converging portion of the abrasive-conducting inlet passage has a cross-section which reduces the passage to approximately the same cross-section dimensions as those of the jet-accommodating passage.

5. The nozzle assembly of claim 1 wherein the housing means includes a flushing passageway in fluid communication with the abrasive-conducting inlet passage closely upstream from the mixing region.

6. The nozzle assembly of claim 5 wherein the flushing passageway is formed about an axis which is oblique to the abrasive-conducting inlet passage.

7. The nozzle assembly of claim 5 wherein the housing means includes a second flushing passageway in fluid communication with the abrasive exit conduit closely downstream from the mixing region.

8. The nozzle assembly of claim 7 wherein the second flushing passageway is formed about an axis which is oblique with the abrasive exit conduit.

9. The nozzle assembly of claim 1 wherein the discharge conduit means includes a generally tubular discharge element having an exterior downstream end region of generally conical shape.

10. The nozzle assembly of claim 9 wherein the tubular discharge element has an inside diameter, and wherein the conical region has a minimum outside diameter approximately twice the inside diameter of the downstream end.

11. The nozzle assembly of claim 1 including means defining an orifice-bypassing discharge path for environmental gasses external to the nozzle assembly which undergo a Bernoulli-induced flow counter to the direction of jet propagation through the discharge conduit towards the jet-forming orifice, so that abrasive material carried by the gasses from the mixing region towards the jet-forming orifice is substantially diverted from reaching the jet-forming orifice.

12. The nozzle assembly of claim 11 wherein the housing means includes a venting passageway in fluid communication at one end with the high velocity jet at a region between the jet-forming orifice and the mixing region, the venting region being in fluid communication at its other end with the environment external to the nozzle assembly.

13. For use in an abrasive-jet nozzle assembly of the type including housing means having an inlet end for receiving high pressure liquid, and an outlet end downstream from the inlet end;

jet-forming orifice-defining means positioned between the inlet and outlet ends for forming a high velocity liquid jet from the high pressure liquid;

the housing means including an abrasive-conducting inlet passage for conducting abrasive from a source external to the nozzle assembly towards a mixing region downstream from the jet-forming orifice, and wherein the housing means further including an abrasive exit conduit i fluid communication with the mixing region for conducting abrasive out of the nozzle assembly along a path separate form that taken by the jet; and means defining a discharge conduit downstream from the mixing region for conducting the jet and entrained abrasive out of the nozzle assembly;

a removably securable insert comprising:

a body of wear-resistant material having a pair of intersecting through-passages, one of said through-passages having a cross-section in the range of 10 to 50 times the diameter of the jet, the other of the passages being convergingly shaped at one end in the direction towards the intersection.

14. The insert of claim 13 wherein the converging portion of said other passage has a minimum cross-section approximately equivalent to the cross-section of the first passage adjacent the intersection.

15. The insert of claim 13 wherein the converging portion of said other passage has a minimum cross-section approximately equivalent to 30% to 70% of its maximum diameter.

16. The insert of claim 13 wherein the two passages are generally perpendicular to each other.

17. An abrasivejet nozzle assembly for use in an abrasive jet cutting system comprising:

housing means having an inlet end for receiving high pressure liquid, and an outlet end downstream from the inlet end;

jet-forming orifice-defining means positioned between the inlet and outlet ends for forming a high velocity liquid jet from the high pressure liquid, the housing means including an abrasive-conducting inlet passage for conducting abrasive from a source external to the nozzle assembly to a mixing region downstream from the jet-forming orifice so that abrasive becomes entrained in the jet, the housing means further including a discharge conduit downstream from the mixing region for conducting the jet and entrained abrasive out of the nozzle assembly.

the housing means further including a venting passage in communication at one end with the environment external to the nozzle assembly, and in communication at its other end with the high velocity jet at a region between the jet-forming orifice and the mixing region, thereby providing an alternative path for Bernoulli-induced flow of external environmental gasses toward the jet-forming orifice which is different than the path defined through the discharge conduit.

* * * * *